US005092221A

United States Patent [19]

Travor et al.

[11] Patent Number: 5,092,221

[45] Date of Patent: Mar. 3, 1992

[54] LAUNCH CONTAINER FOR MULTIPLE STORES

[75] Inventors: Bruce W. Travor, Holland; James F. McEachern, Newtown, both of Pa.

[73] Assignee: The United States of America as represented by the Secretary of the Navy, Washington, D.C.

[21] Appl. No.: 590,875

[22] Filed: Sep. 28, 1990

[51] Int. Cl.[5] ..... B64D 1/04

[52] U.S. Cl. ..... 89/1.51; 89/1.56

[58] Field of Search ..... 89/1.51, 1.56, 1.818; 102/260, 261

[56] References Cited

U.S. PATENT DOCUMENTS

| | | | |
|---|---|---|---|
| 2,562,928 | 8/1991 | Lewis | 102/261 |
| 3,240,200 | 3/1966 | Jones | 89/1.51 |
| 3,451,306 | 6/1969 | Lagerstrom et al. | 89/1.51 |
| 3,603,257 | 9/1971 | White et al. | 102/260 |
| 4,019,421 | 4/1977 | Strom | 89/1.51 |
| 4,026,188 | 5/1977 | Woodruff et al. | 89/1.51 |
| 4,164,887 | 8/1979 | Ouellette | 89/1.51 |
| 4,263,835 | 4/1981 | Dragonuk | 89/1.51 |
| 4,444,085 | 4/1984 | Dragonuk | 89/1.51 |
| 4,474,101 | 10/1984 | Boulard et al. | 89/1.51 |
| 4,733,597 | 3/1988 | Upham | 89/1.51 |

*Primary Examiner*—David H. Brown

*Attorney, Agent, or Firm*—James V. Tura; James B. Bechtel; Susan E. Verona

[57] ABSTRACT

This invention comprises a multi-store, gas-fired launcher that fits into, and is electrically connected with, a transporting vehicle and that contains sequentially-stacked assemblies that generate sufficient gas force to discharge an individual store. An electrical pulse from the transporting vehicle cause a sequencer in the launcher to divert the charge to a burn resistor. At burn-out, a spring-activated striking arm punctures a CO2 bottle which provides sufficient gas pressure to force the store out of the launcher.

5 Claims, 2 Drawing Sheets

FIG. 1
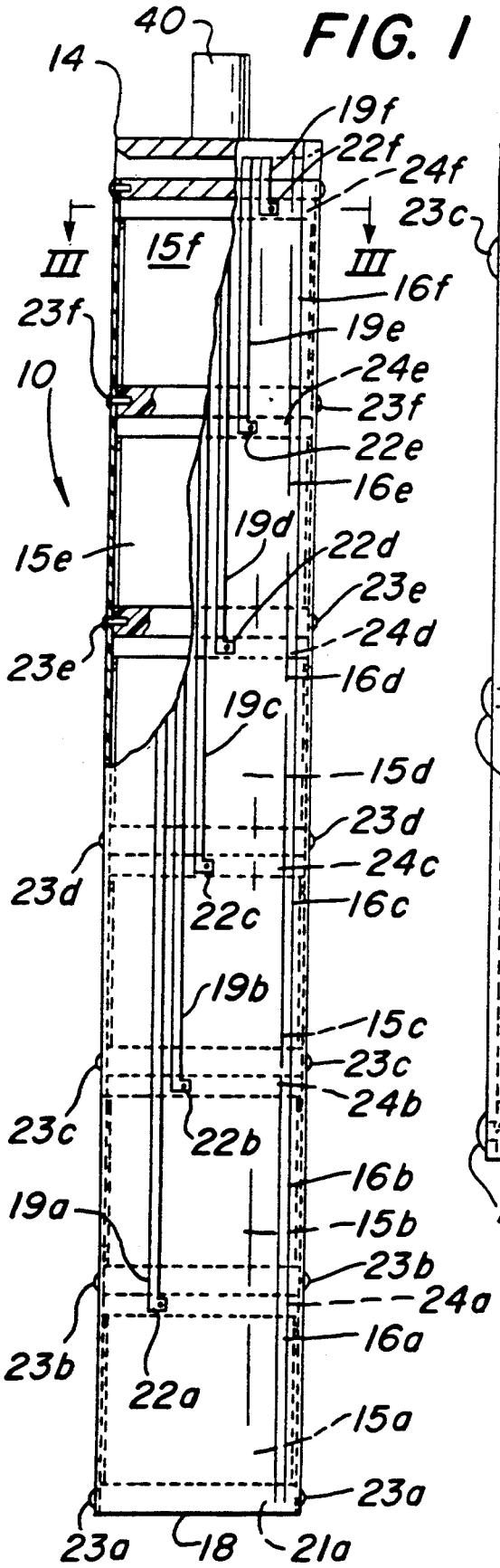
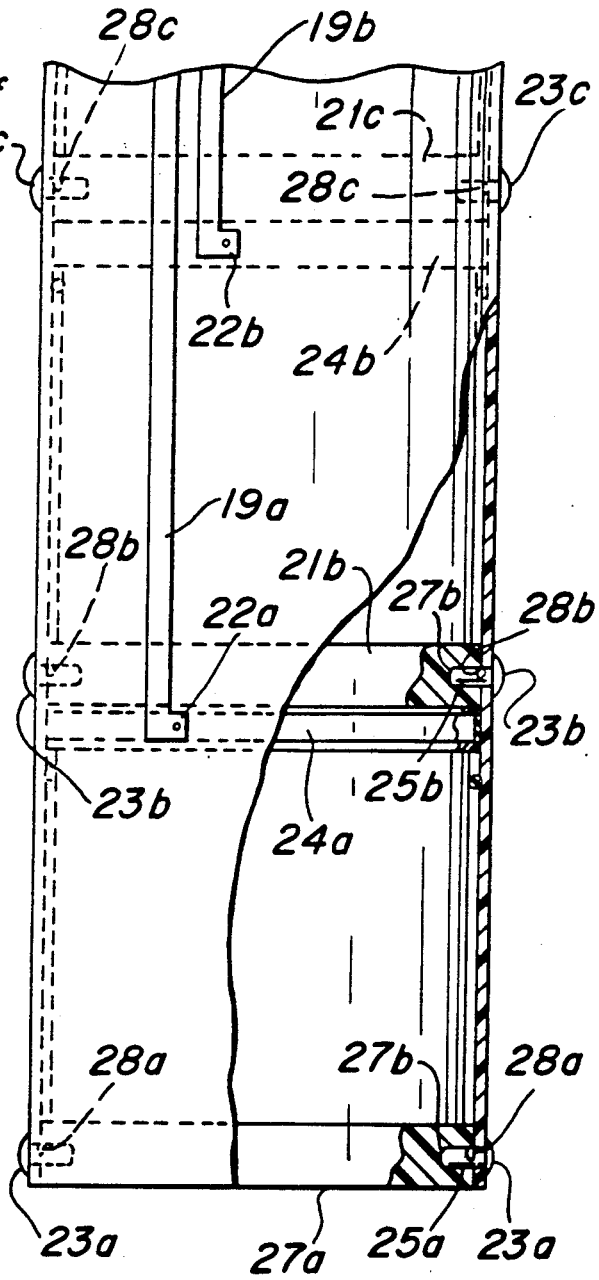
FIG. 2

LAUNCH CONTAINER FOR MULTIPLE STORES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention discloses an electronically-actuated, multi-store dispenser wherein multiple compressed gas assemblies cause sequential launching of stores from their tandem position inside a launch container. In some environments, it is desirable to dispense multiple stores from a launch vehicle, for instance sonobuoys, in dense patterns. Due to physical limitations of space in the dispensing vehicle, an effort was made to miniaturize the active components inside the store and therefore reduce the overall outer dimensions thereof. Once the size of the store was reduced, in order to meet the demands of the denser patterns, the inside of the individual launch containers were modified to allow each to hold and dispense more than one store. This new type of launch container, in addition to maintaining the size requirement dictated by the transporting vehicle, is operated by the vehicle's electrical systems.

SUMMARY OF THE INVENTION

It is therefore an object of the present invention to provide from a standard-size launch container a multi-store launcher for launching, sequentially, a plurality of stores wherein said launcher is adaptable to presently existing transporting vehicles.

It is another object of the present invention to provide a multi-store launcher that is able to use electronic pulses from the transporting vehicle to sequentially activate individual gas cartridges carried adjacent each store to launch each store.

It is still another object of the present invention to provide said multi-store launcher, which uses individual gas cartridges, without making significant alterations to the standard-size launch container.

These and other objects and advantages of the present invention are achieved by providing a standard size, tubular, sonobuoy launch container (SLC) with a sequencer, a multi-outlet wiring harness and a plurality of sequentially stacked sonobuoy and obturator assemblies. The SLC is connected into standard ports of a transporting aircraft and electric power sent to a control module with switching circuitry. The sonobuoy assemblies are sequentially packed into the top of the SLC to secure a gas-cartridge containing obturator package above the sonobuoy, or other store, and a pressure disc immediately therebelow. The obturator package includes a CO2 bottle, a spring-loaded striker and a burn resistor. Upon an electrical pulse being received from the switching circuitry, a failed burn resistor frees the spring-activated striking arm to puncture the CO2 bottle. The gas from the bottle flows through holes in the obturator and produces enough force to cause the buoy and pressure disc to fracture the shear pins holding them in and thus exit the SLC.

BRIEF DESCRIPTION OF THE DRAWINGS

FIG. 1 shows a longitudinal view of a launch container with portions cutaway to diagramatically show the electrical circuitry on the inside of the launch container bore and the pressure seals between individual chambers;

FIG. 2 shows an enlarged fragmentary view of the discharge end of the launch container of FIG. 1;

DETAILED DESCRIPTION OF THE PREFERRED EMBODIMENT

Figure 3:
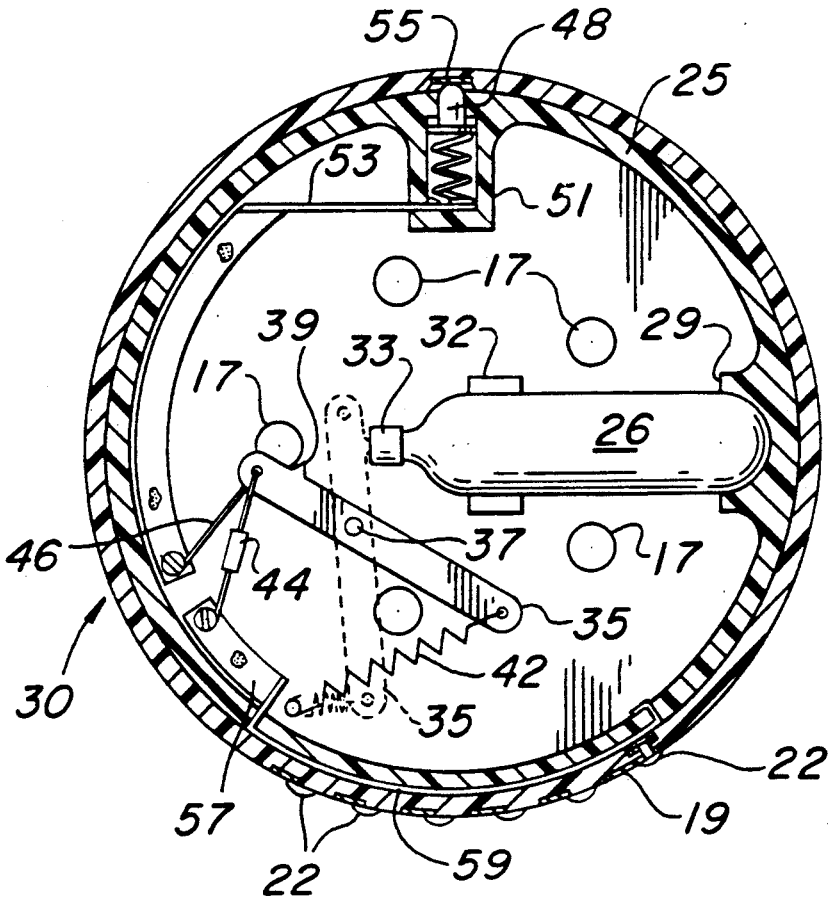
FIG. 3 shows a cross-sectional view of the breech end of the launch container taken at lines III—III of FIG. 1.

A longitudinal sideview, with partial cross-section, of the instant invention is seen in FIG. 1. A standard tubular launcher 10, that connects with a transporting aircraft (not shown) has an electronics module 40 at the interface end 14 to receive electric pulses from the aircraft in the normal manner. Stores 15*a, b, c, d, e* and *f*, such as sonobuoys, are packed inside launch assemblies 16*a, b, c, d, e* and *f*, respectively, for sequential discharge through the discharge end 18 of launcher 10. Launcher 10 can be made from any lightweight, but rigid material such as ABS plastic or aluminum, and has as a connecting wiring harness a corresponding number of electrically-conducting ground leads 19*a, b, c, d, e* and *f* such as copper strips, running from inside of control module 40 (not seen in FIG. 2) along the bore of launcher to each launch assembly. Leads 19 are adhesively bonded along the inner bore of launcher 10 and are at the distil end, riveted to launcher 10. A positive lead 55 runs the entire length of the bore, also.

Each launch assembly 16*a-f* comprises a pressure plate 21*a, b, c, d, e* and *f*, each removeably secured by a pair of breakaway shear pins 23*a, b, c, d, e* and *f*, a store 15*a-f* and a gas generator and obturator package 24*a, b, c, d, e* and *f*. As can be seen more clearly in FIG. 2, each store 15 slidingly fits into the cavity between the inside walls of launcher 10 and is held in place between package 24 and pressure plate 21. Plate 21 can be made of a similar plastic material as launcher 10 and is of sufficient thickness to accommodate the ends of shear pins 23, which pins 23 a.-e fastened through apertures 25 in predetermined locations in the sides of launcher 10 and forced into smaller diameter holes 27 in matching locations in plates 21. Each plate 21 is made to a prespecified diameter that ensures a snug, airtight fit inside of launcher 10 that will withstand a greater pressure than pins 23. Pins 23, as can be seen in FIG. 2, are made with a defect 28 therein to guarantee that they will shear off when an appropriate predetermined pressure is applied.

FIG. 3 shows a cross-sectional plan view of launcher 10 taken along lines III—III of FIG. 1 showing the inside of gas generator and obturator package 24*f*. Packages 24 can be made from a combination of ABS plastic shell filled with polyurethane or other similar material to secure and cushion parts therein and are appropriately sized to fit snuggly inside launcher 10 with gas escape holes 17 cut through the bottom, as shown. Each package 24 comprises a source of compressed gas, such as gas cartridge 26, and an electro-mechanical firing mechanism 30. Cartridge 26 is securely held in place by a molded hollow indentation 29 in the wall of package 24 and a plastic receptacle 32. A thin metal, hermetic seal 33 is placed over cartridge 26 to retain the charged gas therein, as is known in the art.

Mechanism 30, comprises a pivoting striker 35, rotatable on a predetermined pivot point 37, that has at one end, a sharp spike 39, and at the other end, a biasing means, such as helical tension spring 42 of predetermined strength. Striker 35 is restrained, initially, to the open position shown in full by a burn resistor 44 connecting ends of conducting wire 46. Wire 46 is connected into the firing circuitry such that, on one end, a spring-mounted plunger 48, which is electrically connected by compression spring 51 to wire lead 53, maintains contact with a positive lead 55 and, on the other end, terminal 57 is connected via wire lead 59 to ground 19 by rivet 22.

Figure 4:
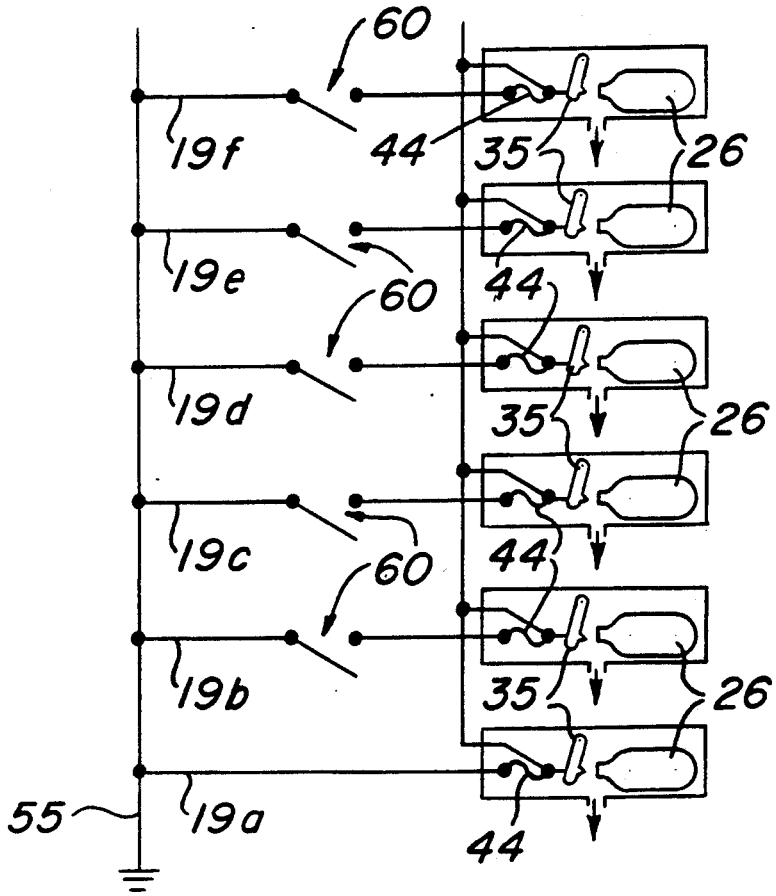
FIG. 4 shows a schematic diagram of the electromechanical circuitry used to discharge stores from the launch container.

FIG. 4 shows schematically the circuit used to sequentially fire a store, or buoy 15. Control module 40 contains pulse limiting circuitry, as is known in the art, that precludes multiple launches where the signal exceeds the predetermined time necessary to burn out the burn-out resistor 44 on the outwardmost store. As the signal is sent to store 15*a*, and resistor 44*a* fails, store 15*a* will be discharged as described above. As store 15*a* leaves its space in launcher 10, a switch 60 completes the circuit for the next store 15*b* such that the next pulse will cause burn resistor 44*b* to fail and break apart, as is known. Remaining stores 15*b*-15*e* are fixed accordingly. Switch 60 can be any micro-switch or spring-loaded switch known in the art.

OPERATION

The launcher 10 is sequentially packed with launch assemblies 16*a-f*, as described. As each assembly is loaded into launcher 10, normally-closed switch 60 is opened. This process is completed for all but the very last assembly 16*a*, which circuit is in the normally closed mode. An operator in the transporting vehicle can initiate a firing signal, and burn resistor 44*a* will fail allowing point 37 to puncture seal 33. The escaping gas from cartridge 26 forces store 15*a* to break shear pins 23*a* and eject, along with plate 21*a*. As store 15*a* leaves, the next switch 60 is allowed to close to complete the circuit to ready store 15*b* for discharge. Sequential stores are fired in the same fashion.

Finally, while the multi-store launcher has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

What we claim is:

1. A transporting and dispensing device to allow storage, transportation and dispensing of at least three stores, comprising:

a. tubular container means for connection into an aircraft at a breech end and adapted to accept an electrical charge and dispense stores at an oppositely-disposed discharge end;

b. pressure resistance means packed adjacent said stores to form an individual pressure-sealed chamber;

c. electrical circuitry means leading from a transporting craft to each of said individual chambers;

d. pressurized gas means located in each chamber and e. firing means comprising a pivotal striker having a spike fixed to a first end and being releasably biased to an open and non-contacting position adjacent said gas means connected to said electrical circuit means and said pressurized gas means so that upon initiation thereof selected stores are dispensed from said container means.

2. A device as descried in claim 1 wherein said pressure resistance means comprises a disc removingly set inside said container means to provide resistance to movement up to a predetermined pressure level.

3. A device as described in claim 1 wherein said electrical circuitry means comprises switching means installed adjacent said stores to divert an electric charge, a wiring harness connecting each said store to a sequencer and a plurality of burn resistors connected therewith, one each adjacent an individual store.

4. A multi-store dispenser comprising:

a. a tubular launcher for insertion at a breech end into a transporting vehicle's receptacle;

b. a switching circuit to receive an electrical signal and divert the signal to an obturator package; and c. a plurality of stores sequentially packed in said launcher, each said store having, on alternating sides, an obturator package containing compressed gas means with gas communicating holes located between the store and said gas means, a spring-loaded striker arm pivotable to release the gas and a burn resistor releasably preventing said striker arm from puncturing said gas means.

5. A transportation and dispensing device for storage and dispensing of a plurality of stores, comprising:

a. tubular container means adapted to receive an electrical charge at a breech end and dispense stores at an oppositely-disposed discharge end;

b. disc means removeably set adjacent each said store to hermetically seal each said store in an individual chamber inside said container means, each said disc means being attached to said container means by a plurality of shear pins;

c. a source of pressurized gas located inside each said chamber;

d. a pivotal striker adjacent said gas source releasably biased to move from a first position to a second position whereupon said gas is released inside said chamber; and e. electrical circuitry extending from said breech end to each said striker and including a plurality of burn resistors, one each adjacent each said striker and holding said striker in said first position, so as to receive an electrical charge sufficient to break said burn resistor and release said striker.

* * * * *